US005626050A

United States Patent [19]

Ploughe et al.

[11] Patent Number: 5,626,050

[45] Date of Patent: May 6, 1997

[54] METHOD OF MAKING METAL BALL BATS

[75] Inventors: Thomas A. Ploughe, Frankfort; Robert C. Pahl, West Lafayette, both of Ind.

[73] Assignee: Aluminum Company of America, Pittsburgh, Pa.

[21] Appl. No.: 351,994

[22] Filed: Dec. 8, 1994

[51] Int. Cl.[6] ..... B21B 17/06

[52] U.S. Cl. ..... 72/370; 72/208

[58] Field of Search ..... 72/208, 209, 214, 72/370; 470/11; 164/344, 345

[56] References Cited

U.S. PATENT DOCUMENTS

| | | | |
|---|---|---|---|
| 2,060,593 | 11/1936 | Schaurte et al. | 470/11 |
| 3,662,815 | 5/1972 | Boyt | 164/344 |
| 3,691,625 | 9/1972 | Swenck | 29/557 |
| 3,729,196 | 4/1973 | Heald, Jr. | 273/72 A |
| 3,735,463 | 5/1973 | Merola | 29/155 C |
| 3,756,062 | 9/1973 | Merola | 72/352 |
| 3,807,213 | 4/1974 | Willis et al. | 72/370 |
| 3,841,130 | 10/1974 | Scott, Jr. et al. | 72/70 |
| 3,854,316 | 12/1974 | Wilson | 72/370 |
| 3,982,416 | 9/1976 | Pozsgay et al. | 72/214 |
| 4,089,199 | 5/1978 | Siemonsen | 72/370 |
| 4,196,607 | 4/1980 | Youtsey et al. | 72/34 |
| 4,430,875 | 2/1984 | Demny et al. | 72/205 |
| 4,602,493 | 7/1986 | Dobrucki et al. | 72/78 |
| 4,827,749 | 5/1989 | Staat et al. | 72/96 |
| 4,866,968 | 9/1989 | Cellier et al. | 72/214 |
| 5,125,251 | 6/1992 | Pettersson et al. | 72/15 |

*Primary Examiner*—Lowell A. Larson
*Assistant Examiner*—Thomas C. Schoeffler
*Attorney, Agent, or Firm*—David W. Pearce-Smith

[57] ABSTRACT

A method of making stock for fabricating a hollow metal ball bat, the stock having a barrel section, a handle section and a tapered section connecting the barrel section and handle section. The barrel section has a first inner and outer diameter. The handle section has a second outer and inner diameter. The second outer and inner diameters are smaller than the first outer and inner diameters. The tapered section has a variable inner and outer diameter along its length and a substantially uniform wall thickness.

11 Claims, 3 Drawing Sheets

METHOD OF MAKING METAL BALL BATS

TECHNICAL FIELD

The present invention relates to methods and apparatus for fabricating metal ball bats. More particularly, the method and apparatus of the present invention relate to a unitary, hollow, metal baseball bat, and to a method of making such bat preferably having a weight distribution approximating that of a solid wooden baseball bat. The present methods are particularly adapted for use with heat treatable aluminum and aluminum alloys.

BACKGROUND ART

Metal ball bats are being used as substitutes for wooden bats because of their light weight. While all sorts of metals might be used, aluminum and its alloys are especially well suited for the purpose, considering strength, weight ratio, surface characteristics, formability, corrosion resistance and cost. While aluminum bats presently cost more than wooden bats, they have the great advantage of lasting longer, and hence of costing less in the long run.

Early efforts to develop aluminum bats included the approach of swaging down a length of a cylindrical extrusion or tube. The extrusion is swaged down by striking or contacting the member with clapping hammers which repetitively strike the outer surface of the extrusion. The striking motion is perpendicular to the longitudinal axis of the tube which causes the exterior diameter of the tube to be reduced thus forming an intermediate tapered portion (also referred to as the trumpet) and handle end of the ball bat.

A bat made in this way has a generally smooth outer surface. However, the interior surface of a ball bat formed by conventional methods is less than smooth. It may have cracks or fractures which run parallel to the longitudinal axis of the ball bat. The cracks weaken the bat and reduce its longevity and are sites for the propagation of stress corrosion cracking.

The swaging process does not result in a uniform wall thickness of the trumpet section. If a prescribed minimum wall thickness is to be achieved, portions of the trumpet will have a wall thickness which greatly exceeds the minimum. The increased wall thickness adds to the weight of the bat. This weight does not contribute to the strength of the bat, and it displaces the center of gravity of the bat away from the hitting end of the bat. In addition, folds of metal form on the inner wall in the swaging process. These metal folds act as sites that initiate stress corrosion cracking. Furthermore, the metal folds add weight to the trumpet and handle of the ball bat.

Accordingly, it would be advantageous to provide a method of forming metal ball bats that results in a smooth crack-free interior surface.

The primary object of the invention is to provide a method of forming metal ball bats with a reduced wall diameter in the trumpet and handle end of the bat that meets the necessary strength requirements.

Another object of the present invention is to provide a method of forming metal ball bats with an increased uniformity in wall thickness in the trumpet and handle end of the bat.

Still another object of the invention is to provide a method of forming metal ball bats with a decreased level of cracks in interior surface of the trumpet and handle end of the bat.

These and other objects and advantages of the present invention will be more fully understood and appreciated with reference to the following description.

SUMMARY OF THE INVENTION

In accordance with these objects, there is provided a method of making tubular bat-shaped stock for fabricating a hollow metal ball bat, the stock having a barrel section, a handle section and a tapered section connecting the barrel section and handle section. The barrel section has a first inner and outer diameter. The handle section has a second outer and inner diameter. The second outer and inner diameters are smaller than the first outer and inner diameters. The tapered section has a variable inner and outer diameter along its length and a substantially uniform wall thickness. The method includes: (a) providing a cylindrical aluminum tube blank having a generally uniform wall thickness and outer and inner diameters equal to the first outer and inner diameters; (b) rigidly fixing the first end of the aluminum tube into a "pusher", the pusher having a cylindrical opening having an diameter slightly larger than the outer diameter of the aluminum tube blank; (c) positioning a mandrel rod inside the aluminum tube, the mandrel rod having a leading section, a transition section and a trailing section, the leading section having an outer diameter approximately equal to the second inner diameter of the handle section, the transition section having an outer diameter approximately equal to the variable inner diameter of the tapered section, the trailing section having an outer diameter approximately equal to the second inner diameter of the barrel section, the mandrel rod supporting the cylindrical aluminum tube blank; (c) advancing the pusher to a "reducing rolling mill"; and (d) feeding the aluminum tube blank into the reducing rolling mill and longitudinally reducing the aluminum tube to form the handle section and the tapered section and thereby form bat-shaped stock for fabricating a hollow metal ball bat.

Another aspect of the present invention is an extraction rod for removing the recently formed stock from the rolling mill machine. The extraction rod has a threaded cylindrical end sized to insert into a cylindrical opening of the formed metal extrusion. Preferably, the threaded cylindrical end of the extraction tool has a diameter less than about 0.5 inch smaller than the cylindrical opening. In the method of forming stock for a hollow metal ball bat described above, the extraction tool is used by (e) inserting a threaded extraction rod into the handle section; (f) binding the extraction rod so that it is fixed inside the handle section; (g) withdrawing the mandrel rod from the stock; and (h) using the extraction rod to extract the tubular stock form the pusher.

Still another aspect of the present invention is an adapter tube for use in a tube reducing mill. The adapter converts a tube reducing mill so that it can be used with stock that has a length which is shorter than the minimum length for which it is designed. The adapter tube comprises an outer diameter greater than the outer diameter of the stock and an inner diameter smaller than outer diameter of the stock. The first end of the adapter tube is designed for receiving the stock. The first end has a reduced wall section such that the inner diameter of the reduced wall section is greater than the outer diameter of the stock. In a preferred embodiment, the adapter has an inner wall formed at the inner end of the reduced wall section. The inner wall has a thickness greater than the thickness of the side wall of the stock to be reduced.

BRIEF DESCRIPTION OF THE DRAWINGS

Other features of the present invention will be further described in the following related description of the preferred embodiment which is to be considered together with the accompanying drawings wherein like figures refer to like parts and further wherein.

MODE FOR CARRYING OUT THE INVENTION

Figure 1:
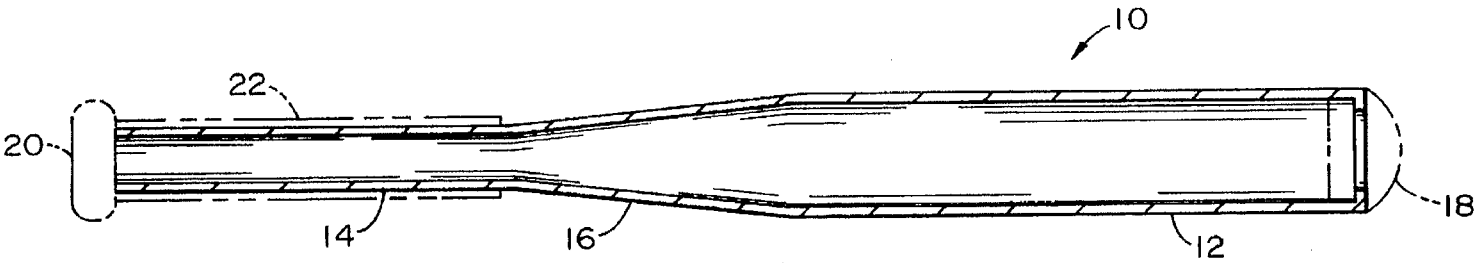
FIG. 1 shows diagrammatically a cut view of a metal tube blank made in accordance with the principles of the invention.

Turning first to FIG. 1, there is illustrated a metal tube blank 10 made in accordance with the principles of the invention. More particularly, the bat comprises a barrel portion 12, a handle or grip portion 14 and a tapered portion 16 located between said barrel and handle portions.

Bat 10 is formed from a cylindrical tube (not shown) of uniform wall thickness. However, the wall thickness of the three portions of bat 10 are different. Wall thickness of barrel portion 12 is the same as the original thickness of the cylindrical tube. As will be explained in greater detail below, in the process of reducing the diameter of handle or grip portion 14 and tapered portion 16, the wall thickness of these portions are intentionally reduced. The reduced wall thickness at the handle end of the bat 10 results in a reduction in the overall weight of the bat. This is highly desirable in that a lighter bat can be swung faster than a heavier bat. In addition, the thicker walls are in barrel portion 12 which is the portion of the bat that is designed to contact a thrown ball. This is highly desirable since the thicker wall section of the barrel portion of the bat imparts greater strength and durability to this portion of the bat.

Bat 10 is closed with plugs 18 and 20 (shown in dash outline) made of light-weight natural or synthetic rubber, or a polyvinyl chloride plastic, though other light-weight, shock-resistant materials and material combinations may be used. Plug 18 in the barrel end of bat 10 may be secured therein by the extremity of the barrel end being turned inwardly to engage the plug as shown in FIG. 1. Plug 20 located in the handle end of bat 10 may include an integral sleeve 22 slipped over the handle portion (as shown) to provide a rubber hand gripping area for the bat.

Figure 2:
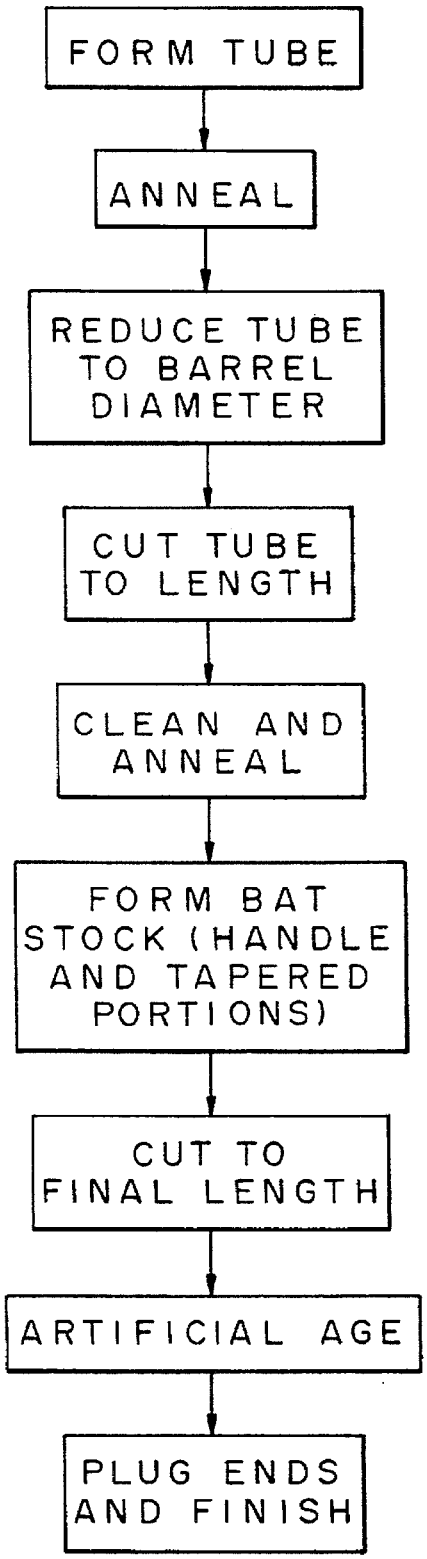
FIG. 2 is a process flow diagram showing the steps in forming a bat from extruded or drawn tube to shipping the final product.

Turning next to FIG. 2, there is illustrated a process flow diagram showing the basic steps in forming a bat from extruded or drawn tube to finishing the final product. Essentially, the procedure followed in the process includes the following steps:

Tube stock is first formed from a single-piece metal tube (not shown). To this end, a hollow tube is preferably extruded or drawn to have substantially uniform diameter and wall thickness. Next, the formed tube is annealed to soften the metal and undo the work hardening imparted to the metal during the forming step.

The annealed tube is then tube reduced from a larger diameter extrusion to a diameter which is equal to the desired diameter of barrel portion 12 of bat 10. The diameter of the tube is reduced in a tube reducer such as a pilger mill. The reduction may be accomplished in a single pass in a tube reducer or in multiple passes. During the tube reducing step(s), the wall thickness of tube is also reduced so that it has the wall thickness specified for the barrel portion of the bat. The tube reducing is desired in that it improves the uniformity of wall thickness and improves the tube's eccentricity.

Next, the reduced tube is cut to length, cleaned and annealed. The tube is then cut into predetermined lengths which minimize the amount of scrap metal that needs to be removed after the final forming steps. The length is somewhat shorter than the desired bat length since the process of forming handle portion 14 and tapered portion 16 will cause the overall length of the bat stock to elongate. The cut tube is cleaned to remove unwanted surface materials. The cleaned bat is annealed to soften the metal and undo the work hardening imparted to the metal during the tube reducing step(s).

Figure 3:
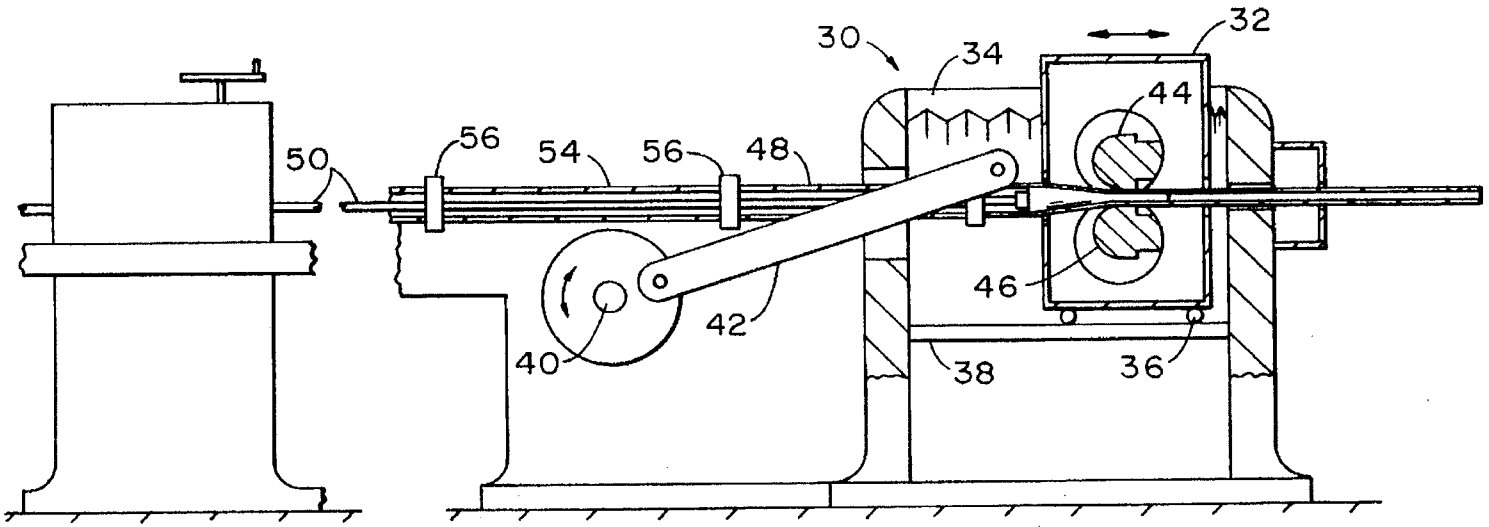
FIG. 3 is a side view of a tube reducing machine used in forming the bat of the present invention showing forming dies in the closed position.

The cut tube is then placed into a tube reducing machine similar to that shown in FIG. 3, and bat-shaped stock is formed therefrom. Since the cut lengths are shorter than many commercially designed reducing machines can handle, it may be necessary to use an adapter.

Turning next to FIG. 3 there is illustrated a side view of tube reducing machine 30 used in forming a bat of the present invention. Tube reducing machine 30 has an oscillating head 32 located in the working end 34 of reducing machine 30. Oscillating head 32 moves longitudinally back and forth on rollers 36 along at least two tracks 38 (only one of which is visible in FIG. 3). Oscillating head 32 is moved by a drive shaft 40 connected to a crank 42.

Figure 4:
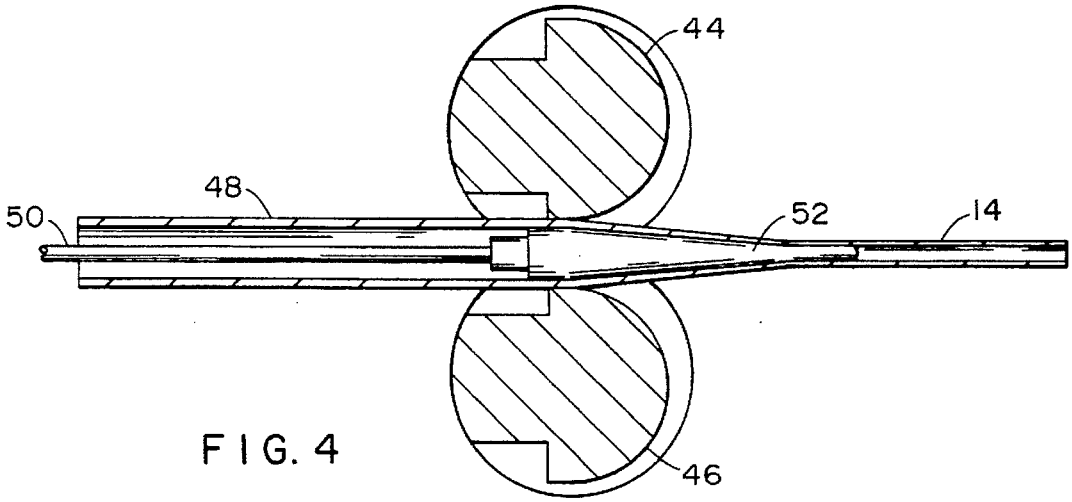
FIG. 4 is an enlarged view of the oscillating head of the tube reducing machine of FIG. 3 showing the formed ball bat and forming dies in the opened position.

As oscillating head 32 moves back and forth, upper and lower dies 44 and 46 rotate from a closed position (shown in FIG. 3) to an open position (shown in FIG. 4). In the open position, dies 44 and 46 are spaced apart from each other so that stock tube 48 fits therebetween. Dies 44 and 46 are tangential reducing dies designed to apply a force to squeeze stock tube 48 and cause it to be reduced.

A mandrel rod 50 extends the length of reducing mill 30. The rod is positioned so that it is in the interior of stock tube 48. The diameter of mandrel rod 50 is not critical in practicing the present invention except that it must be smaller than the diameter of stock tube 48. At the work end of mandrel rod 50 is tapered mandrel 52. Mandrel 52 is sized and shaped to match the size and shape of the interior wall of the trumpet section of the bat to be formed. Dies 44 and 46 locally squeeze stock tube 48 against mandrel 52 causing the interior wall of stock tube 48 to deform and take on the size and shape of mandrel 52. As the diameter of stock tube 48 is reduced, metal flows away from mandrel 52 and forms handle 14 and tapered section 16 (shown in FIG. 1).

In operation, stock tube 48 is positioned so that it is axially aligned with the mandrel rod 50 and a shell tube 54. Tube stock 48 is annealed to soften the metal and thus facilitate the working of the metal in the forming process. Shell tube 54 is advanced to butt against stock tube 48 and align stock tube 48 with the space between dies 44 and 46. Grips 56 are used to hold shell tube 54 and thus stock tube 48 in position. Mandrel rod 50 is mechanically advanced toward the work end 34 of mill 30 and enters stock tube 48. Mandrel rod 50 continues to advance until mandrel 52 is positioned between open dies 44 and 46 (shown in FIG. 4).

Next, shell tube 54, grips 56 and stock tube 48 are mechanically advanced approximately one-half inch increments into the interstice of dies 44 and 46. Crank 42 is rotated to move drive shaft 40 and cause oscillating heads 32 to move on tracks 38. This causes dies 44 and 46 to rotate in a direction perpendicular to the longitudinal axis of stock tube 48 and move from an open position (FIG. 4) to a closed position. This causes stock tube 48 to deform locally and conform to the shape of mandrel 52. Metal from stock tube 48 elongates axially away from mandrel 54 and forms part of the handle section of the bat.

Crank 52 is then rotated to cause dies 44 and 46 to rotate in a direction perpendicular to the longitudinal axis of stock tube 48 and move from their closed position (FIG. 3) to an open position. Simultaneously with the opening of dies 44 and 46, stock tube 48 is rotated by one-fifth of its diameter (72°). Grips 56 and stock tube 48 are then advanced approximately one half inch into the interstice of dies 44 and 46. The process is then repeated until the length of the handle is adequate for the purposes of forming a bat.

The mechanical work performed on the tube during the deformation process heats stock such that it cannot be readily handled without suitable equipment. In addition, the newly-formed bat is inside work end 34 of mill 30, and removing it by hand from the inside of oscillating head 32 would involve a safety risk. Applicants have therefore invented a device and method for removing the newly-formed bat from reducing mill 30.

Figure 5:
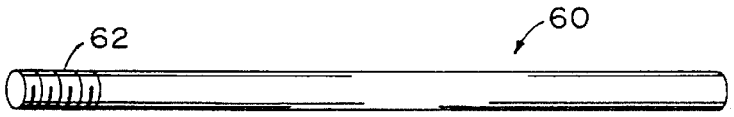
FIG. 5 is a side view of an extraction device for removing the formed ball bat from a tube reducing machine.

The bat is removed from reducing mill 30 by first withdrawing mandrel rod 50 from mandrel 52 so that the contact between mandrel 52 and the newly-formed bat is broken. A metal extraction rod 60 (FIG. 5) is axially aligned with tube stock 48 inserted into handle end 14. Extraction rod 60 is cylindrical and preferably made of an aluminum alloy. Extraction rod has a threaded end 62 that inserts into handle 14. In addition, extraction rod 60 is sized to insert into a cylindrical opening of the formed metal extrusion. Preferably, the threaded cylindrical end 62 of extraction rod 60 has a diameter less than about 0.5 inch smaller than the cylindrical opening. Once the threaded end 62 of the extraction rod is inserted into handle section 14, it is fixed or mechanically bound inside the handle section. This is accomplished by a pivoting rod to move it out of axial alignment with tube stock 48. Care is taken not to pivot the extraction tool with sufficient force to damage the formed handle section.

The rod and tube stock 48 are then jointly removed by an operator from the oscillating head. The extraction rod is pivoted to axially align it with tube stock 48 and unbind it therefrom. The reduced tube stock is allowed to cool to room temperature.

The tube stock is then cleaned, cut to final size, solution heat treated, aged to harden the metal, and given the desired surface finish. Plugs 18 and 20 (FIG. 1) are now inserted into the handle and barrel ends of the bat, and sleeve 22 is placed on handle section 14.

After the forming process or before the forming process, depending in a large degree upon the metal and alloys employed, the metal of the bat is tempered preferably by the heat treating and age hardening (T6) process described in Vernam et al U.S. Pat. No. 3,171,760. In the process of forming described above, the metal of the bat is subjected to stresses which tend to weaken the metal. With subsequent stresses imposed on the bat via the normal use thereof, cracks can occur in the weakened areas of the bat which, in turn, allow corrosion to occur in the cracks thereby causing further weakening and deterioration of the metal. By the solution heat treating and age hardening (T6) process described in the Vernam et al patent, the metal of the formed bat is hardened and made resistant to stress corrosion cracking, thereby providing a long-life, dent-resistant bat without the need of further strengthening devices. Though the T6 temper is preferred for the bat of the invention, other tempers may be used including T7 and T53 tempers.

Wall thickness dimensions for the bat of the invention made from 7005 or 7075 aluminum alloys are preferably in the range of 0.080 to 0.130 inch for outside diameter barrels ranging from 2 to 2¾ inches.

Figure 6:
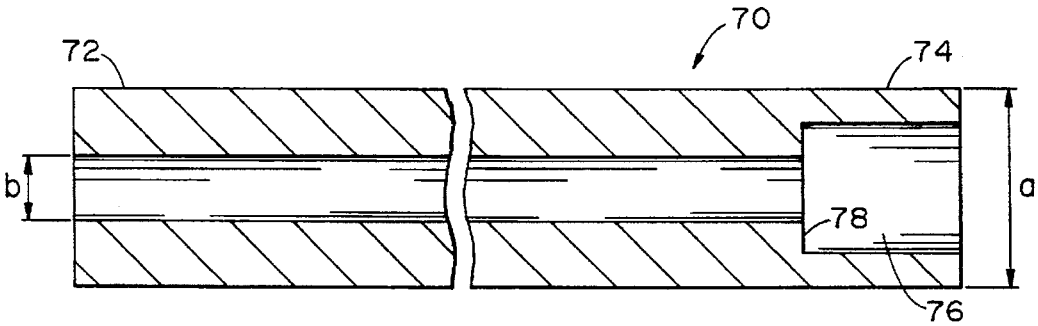
FIG. 6 is a side view of the an adapter for use in practicing the invention.

Turning next to FIG. 6, there is illustrated an adapter 70 for use in tube reducing mill 30. Adapter 70 permits a tube reducing mill, such as that shown in FIG. 3, to be used with stock that has a length which is shorter than the minimum length for which the tube reducing mill is designed. Adapter 70 can be any length, depending on the length of the part to be reduced and the equipment. However, it is contemplated that the length of adapter 70 will be between 5 and 75 feet. Adapter tube 70 has a first end 72 for contacting the carriage of a reducing mill and a second end 74 for contacting the tube stock to be reduced.

Adapter 70 is a generally cylindrical, hollow tube which is preferably fabricated from a hard aluminum alloy that has been artificially aged to increase its strength. The outer diameter "a" of adapter 70 is greater than the outer diameter of the tube stock that is to be reduced. Inner diameter "b" of adapter 70 is smaller than the outer diameter of the tube stock to be reduced. Thus, the end of adapter 70 will rest against the tube stock to be reduced. Additionally, inner diameter "b" is large enough to allow mandrel 52 (FIG. 3) to pass therethrough.

Second end 74 of adapter 70 has a holding area 76 which terminates in a shelf 78. The diameter of holding area 76 is 0.025 to 0.50 inch larger than the outer diameter of the tube stock. Shelf 78 is flat and generally perpendicular to the longitudinal axis of adapter 70.

In use, adapter 70 is placed into reducing mill 30, and tube stock 48 is aligned as described above. Adapter 70 is advanced toward work end 34 of reducing mill 30 until the end of tube stock 48 is inside holding area 76 and at rest on shelf 78. Mandrel rod 50 and mandrel 52 (FIG. 3) are passed through adapter 70, and the process of reducing the tube stock proceeds as before.

From the foregoing description, it should now be apparent that a new and useful ball bat has been disclosed along with a novel method of making the bat. The bat, and the method of making it, result in considerable savings in metal, and thus savings in the cost of the bat as well as effecting the weight distribution without the use of weights added to the barrel end of the bat.

The benefit of the present invention is illustrated in the following example.

EXAMPLE

AA7050 was extruded into hollow tube, and the tube was cut into 15-foot lengths. The tube material had an outer diameter (OD) of approximately 3.5 inches and a wall thickness of 0.300 inch. The 15-foot lengths were annealed at a temperature less than about 700° F. and cooled. The 15-foot lengths were then tube reduced to 2.9 inches OD and a wall thickness of 0.150 inch. The length of the reduced material was approximately 34 feet.

Next, the 34-foot lengths were cut into lengths of approximately 17 feet and annealed at a temperature less than about 700° F. and cooled. The 17-foot lengths were then drawn to 2.75 inches OD and a wall thickness of 0.110 inch. The length of the drawn material was approximately 27 feet.

Next, the 27-foot lengths were cut into lengths of approximately 21 inches and cleaned to remove surface debris and annealed at a temperature less than about 700° F. and cooled. The 21-inch lengths were then tube reduced to form the handle portion and the tapered portion of the bat.

The formed bats were sectioned, and wall thickness in the handle portion and the barrel portion were measured at several locations along the length of the bat. The interior walls of the formed bats were examined for folds and cracks. Surprisingly, no folds or cracks were found. When commercially available bats were examined, folds were found.

Unexpectedly, the variation in wall thickness of the bats in the trumpet and handle section was less than 0.002 inch. Typically, the variation in the wall thickness in the trumpet handle sections of commercially available bats, which were formed using processes other than one described, was in the range of 0.150 to 0.200 inch. The reduced variation in wall thickness in the trumpet and the handle end of the bat results in a reduction in the overall weight of the bat. This is highly desirable in that a lighter bat can be swung faster than a heavier bat.

More importantly, the reduced variation in wall thickness in the trumpet and the handle end of the bat allows for the formation of bats with a lower median wall thickness than might otherwise be possible. Lowering the average wall thickness of the trumpet and handle without creating weak spots due to inadvertent formation of thin and therefore weak sections of bat allows for a further weight reduction. Heretofore, large variations in wall thickness were accepted as part of the random variability in the forming process. This random variability is planned into bat designs so that the bats are formed with a median wall thickness that is greater than required to meet the overall minimum strength requirements.

The actual magnitude of the wall thickness needed for a bat is determined by adding the desired thickness required to meet the overall minimum strength requirements and the variation resulting from the forming process. Thus, if a portion of the bat was formed with a section that had a thin wall because of a large variation in the wall thickness, the resulting wall thickness of the bat would still be acceptable. This technique, although effective in reducing the number of rejects due to thin wall section, resulted in the formation of bats with an increased median wall thickness. One intentionally designed a cushion or safety margin in the wall thickness to compensate for the chance that random variability would create a bat with an area that was unacceptably thin. This is highly desirable since the thicker wall sections not only weigh more but also contain more metal and so increase the cost of raw materials.

Whereas the preferred embodiments of the present invention have been described above in terms of being especially valuable in the quenching of aluminum alloy parts, it will be apparent to those skilled in the art that the present invention will also be valuable in the quenching of other metals. Metals suitable for use with the present invention are not limited to aluminum and aluminum alloys. Objects formed from other metals such as magnesium, copper, iron, zinc, nickel, cobalt, titanium, and alloys thereof may also benefit from the present invention.

Whereas the preferred embodiments of the present invention have been described above in terms of being especially valuable in producing 7050 aluminum alloy bats, it will be apparent to those skilled in the art that the present invention will also be valuable in producing parts made of other aluminum alloys containing about 75% or more by weight of aluminum and one or more alloying elements. Among such suitable alloying elements is at least one element selected from the group of essentially character-forming alloying elements consisting of manganese, zinc, beryllium, lithium, copper, silicon and magnesium. These alloying elements are essentially character forming for the reason that the contemplated alloys containing one or more of them essentially derive their characteristic properties from such elements. Usually the amounts of each of the elements which impart such characteristics are, as to each of magnesium and copper, about 0.5 to about 10 wt. % of the total alloy if the element is present as an alloying element in the alloy; as to zinc, about 0.05 to about 12.0 wt. % of the total alloy if such element is present as an alloying element; as to beryllium, about 0.001 to about 5.0 wt. % of the total alloy if such element is present as an alloying element; as to lithium, about 0.2 to about 3.0 wt. % of the total alloy if such element is present as an alloying element; and as to manganese, if it is present as an alloying element, usually about 0.15 to about 2.0 wt. % of the total alloy.

The elements iron and silicon, while perhaps not entirely or always accurately classifiable as essentially character-forming alloy elements, are often present in aluminum alloys in appreciable quantities and can have a marked effect upon the derived characteristic properties of certain alloys containing the same. Iron, for example, which if present and considered as an undesired impurity, is sometimes desirably present and adjusted in amounts of about 0.3 to 2.0 wt. % of the total alloy to perform specific functions in certain alloys. Silicon may also be so considered, and while found in a range varying from about 0.25 to as much as 15 wt. %, is found in the range of about 0.3 to 1.5 wt. % to perform specific functions in certain alloys. In light of the foregoing dual nature of these elements and for convenience of definition, the elements iron and silicon may, at least when desirably present in character-affecting amounts in certain alloys, be properly also considered as character-forming alloying ingredients.

Such aluminum and aluminum alloys, which may contain one or more of these essential character-forming elements, may contain, either with or without the aforementioned character-forming elements, quantities of certain well known ancillary alloying elements for the purpose of enhancing particular properties. Such ancillary elements are usually chromium, nickel, zirconium, vanadium, titanium, boron, lead, cadmium, bismuth, and occasionally silicon and iron. Also, while lithium is listed above an essential character forming element, it may in some instances occur in an alloy as an ancillary element in an amount within the range outlined above. When one of these ancillary elements is present in the aluminum alloy of the type herein contemplated, the amount, in terms of percent by weight of the total alloy, varies with the element in question but is usually about 0.05 to 0.4 wt. %, titanium about 0.01 to 0.25 wt. %, vanadium or zirconium about 0.05 to 0.25 wt. %, boron about 0.0002 to 0.04 wt. %, cadmium about 0.05 to 0.5 wt. %, and bismuth or lead about 0.4 to 0.7 wt. %.

The aluminum alloys included most preferably the wrought and forged aluminum alloys such as those registered with the Aluminum Association by the designations 6101, 6201, 6009, 6010, 6151, 6351, 6951, 6053, 6061, 6262, 6063, 6066, 6070, 7001, 7005, 7010, 7016, 7021, 7029, 7049, 7050, 7150, 7055, 7075, 7175(b), 7475, 7076, 7178 and other appropriate alloys of similar designation. Of particular interest are the aluminum alloys 6061, 7050, 7055and 7075. These aluminum alloys generally include the generic designation 6000 series alloys and 7000 series alloys.

Although the invention has been described in terms of forming baseball bats, it is not intended to be so limited. The invention is intended to be equally applicable to forming other tubular products such as table legs, segments to chairs, pool cues, bowling pins and the like.

Although the invention has been described in terms of forming baseball bats in a tube reducing mill containing tangential clearance dies, it is to be appreciated that other types of clearance dies can also be used in practicing the invention. Thus, for example, dies having a parabolic clearance or a parabolic clearance with extra tangential clearance may also be used in practicing the invention.

What is believed to be the best mode of the invention has been described above. However, it will be apparent to those skilled in the art that numerous variations of the type described could be made to the present invention without departing from the spirit of the invention. The scope of the present invention is defined by the broad general meaning of the terms in which the claims are expressed.

What is claimed is:

1. A method of making stock for fabricating a hollow metal ball bat, said stock having a barrel section, a handle section and a tapered section connecting said barrel section and handle section, said barrel section having a first inner and outer diameter, said handle section having a second outer and inner diameter, said second outer and inner diameters being smaller than said first outer and inner diameters, said tapered section having a variable inner and outer diameter along its length and a substantially uniform wall thickness, the method comprising:

(a) providing a cylindrical tube blank having a generally uniform wall thickness and outer and inner diameters equal to said first outer and inner diameters;

(b) rigidly fixing said first end of said tube into a pusher, said pusher having a cylindrical opening of a diameter slightly larger than said outer diameter of said tube blank;

(c) positioning a mandrel rod inside said tube, said mandrel rod having a leading section, a transition section and a trailing section, said leading section having an outer diameter approximately equal to said second inner diameter of said handle section, said transition section having an outer diameter approximately equal to said variable inner diameter of said tapered section, said trailing section having an outer diameter approximately equal to said second inner diameter of said handle section, said mandrel rod supporting said cylindrical tube blank;

(d) advancing said pusher to a reducing rolling mill; and (e) feeding said tube blank into said reducing rolling mill and longitudinally reducing the diameter of a portion of said tube to form said handle section and said tapered section and thereby form stock for fabricating a hollow metal ball bat.

2. The method of claim 1 which further includes:

(e) inserting a threaded extraction rod into said handle section;

(f) binding said extraction rod so that it is fixed inside said handle section;

(g) withdrawing said mandrel rod from said stock; and (h) using said extraction rod to extract said stock from said pusher.

3. The method of claim 1 which further includes:

trimming the ends of said stock.

4. The method of claim 1 which further includes:

solution heat treating said stock.

5. The method of claim 1 which further includes:

artificially aging said stock.

6. The method of claim 1 wherein said tube blank is formed from an aluminum alloy.

7. An adapter tube for use in a tube reducing mill, said adapter tube permitting stock which has a length less than a minimum length for which the tube reducing mill is designed to be processed in said tube reducing mill, said adapter tube comprising:

(a) an outer diameter greater than the outer diameter of said stock; and (b) an inner diameter smaller than the outer diameter of said stock.

8. The adapter tube of claim 7 which further comprises a first end for receiving said stock, said first end having a reduced wall section having an inner diameter, an outer diameter, an inner end and an outer end, the inner diameter of said reduced wall section being greater than the outer diameter of said stock.

9. The adapter tube of claim 8 which further comprises:

(c) a shelf formed at the inner end of said reduced wall section, said shelf having a height greater than the thickness of the side wall of said stock.

10. The adapter tube of claim 8 which further comprises:

(c) a hard aluminum alloy that has been artificially aged to increase its strength.

11. The adapter tube of claim 7 in which said reducing mill has an automatic feed shut off and the length of said adapter tube is such that the automatic feed shut off is activated as the stock is finished being reduced.

* * * * *